US005477434A

United States Patent [19]

Reed

[11] Patent Number: 5,477,434

[45] Date of Patent: Dec. 19, 1995

[54] EXTENSION BAR WITH BUILT-IN LIGHT USED IN CONJUCTION WITH A PORTABLE DRIVING TOOL

[75] Inventor: Danny D. Reed, Seven Valleys, Pa.

[73] Assignee: Fisher Tool Co., Inc., Los Angeles, Calif.

[21] Appl. No.: 278,499

[22] Filed: Jul. 21, 1994

[51] Int. Cl.[6] ..... B25B 13/46

[52] U.S. Cl. ..... 362/119; 362/202; 362/203; 81/177.2; 81/177.85

[58] Field of Search ..... 362/119, 202, 362/109, 203, 120; 81/60, 61, 62, 63, 63.1, 63.2, 479, 177.2, 124.6, 439, 177.85, 177.5; 403/322, 325, 321, 17, 324

[56] References Cited

U.S. PATENT DOCUMENTS

| | | | |
|---|---|---|---|
| 2,134,081 | 10/1938 | Gaede | 362/119 |
| 2,341,375 | 2/1944 | Hambleton | 362/119 |
| 2,783,364 | 2/1957 | Wood | 362/119 |
| 3,227,948 | 1/1966 | Cheshire | 362/203 X |
| 4,253,134 | 2/1981 | Barnaby | 362/119 |
| 4,324,158 | 4/1982 | Le Roy | 362/119 X |
| 4,999,750 | 3/1991 | Gammache | 362/203 |

*Primary Examiner*—Ira S. Lazarus
*Assistant Examiner*—Thomas M. Sember
*Attorney, Agent, or Firm*—Adduci, Mastriani & Schaumberg

[57] ABSTRACT

An extension bar with built-in light to be used in conjunction with a portable driving tool which has a coupling member. The extension bar comprises an elongated body having a socket for accommodating and receiving the coupling member of the driving tool at one end, and a coupling member at an opposite end. The socket is connected to an internal chamber of the elongated body, and the coupling member has a through bore which is also connected to the internal chamber. A built-in light assembly is installed inside the internal chamber of the elongated body and including a light bulb and a battery, the light bulb located adjacent to the through bore. The built-in light assembly has an electrical conducting and switching mechanism for establishing electrical connection between the battery and the light bulb and automatically switching on the light bulb when the extension bar is attached to the driving tool, and switching off the light bulb when the extension bar is detached from the driving tool. Therefore, when the extension bar is attached to the driving tool, it serves not only as an extension of the driving tool but also as a flashlight to illuminate the working area.

9 Claims, 3 Drawing Sheets

EXTENSION BAR WITH BUILT-IN LIGHT USED IN CONJUCTION WITH A PORTABLE DRIVING TOOL

BACKGROUND OF THE INVENTION

1. Field of the Invention

The present invention relates to the field of portable tools. More particularly, the present invention relates to the field of extension bars used between a portable driving tool and a socket wrench or a screw head.

2. Description of the Prior Art

It is known in the prior art that a portable driving tool can be attached to a socket wrench or a screw head for the purpose of tightening or loosening the socket wrench or screw head. For example, as shown in FIG. 1, a socket wrench 10 can be tightened or loosened by using a ratchet driver 20. The socket wrench 10 typically has a socket 12 at its one end. The socket 12 may be square, hexagonal or polygonal shaped. The ratchet driver 20 typically has a handle 22. At one end of the ratchet driver 20 there is a ratchet mechanism 24. The ratchet mechanism 24 includes a coupling member 26 which is complementary to and can be received in the socket 12 of the socket wrench 10. The coupling member 26 may have a small spring-biased ball 28 for tight engagement with the socket 10.

Once the coupling member 26 of the ratchet driver 20 is received within the socket 12 of the socket wrench 10, the socket wrench 10 can be tightened or loosened by swinging the handle 22 of the ratchet driver 20 in the appropriate direction. It is noted that in the position of the socket wrench 10 there could be a screw head having a socket similar to the socket 12 of the socket wrench, where the ratchet driver 20 or other similar driving tools can be used in similar fashion to tighten or loosen the screw.

However, often times there is not enough clearance in the working space immediately adjacent to a socket wrench or a screw head. In such situation, an extension bar is needed to be used in between the socket wrench or the screw head and the driving tool. The present invention is a new design and construction of an extension bar used in conjunction with a driving tool and a socket wrench or a screw head.

SUMMARY OF THE INVENTION

The present invention is an extension bar with built-in light to be used in conjunction with a driving tool.

It is known that when it is hard to reach the socket wrench or the screw with the driving tool, or when there is not enough clearance in the working space immediately adjacent to a socket wrench or a screw head to enable the user to swing the handle of a driving tool to tighten or loosen the socket wrench or the screw, an extension bar can be used in between the driving tool and the socket wrench or the screw head to increase the distance therebetween, so that the socket wrench or the screw can be reached by the driving tool and so that there is enough space to operate the driving tool.

However, one of the problems experienced in using the prior art extension bars is that in many situations, the area surrounding the socket wrench or the screw head is very narrow and not well illuminated. For example, when the socket wrench is used in a deep well (where such wrench is often called a "deep well wrench"), it is often very dark inside the deep well, which makes it quite hard to locate the socket wrench or to align the extension bar with the socket wrench.

It has been discovered, according to the present invention, that if a new extension bar is designed and constructed with a built-in internal light, then the new extension bar can be used as not only an extension bar but also as a flashlight to illuminate the socket wrench, so that the socket wrench can be easily located and the extension bar can be easily aligned with the socket wrench.

It has also been discovered, according to the present invention, that if the components of the built-in light assembly of the new extension bar, including the light bulb and the battery, are all contained in an insulated casing, then the built-in light assembly can be easily installed or replaced as one integral unit.

It has been further discovered, according to the present invention, that if the new extension bar has a switch mechanism which automatically switches on the built-in light when the extension bar is attached to the driving tool, and switches off the built-in light when the extension bar is detached from the driving tool, then the built-in light can continuously illuminate the working area when the extension bar is in use, and conserve the battery power when the extension bar is not in use.

It is therefore an object of the present invention to provide a new extension bar with built-in light, so that when the new extension bar is used in conjunction with a driving tool to reach a socket wrench, the extension bar serves not only as an extension bar but also as a flashlight to illuminate the socket wrench, to easily locate the socket wrench and align the extension bar with the socket wrench.

It is also an object of the present invention to provide a new extension bar with built-in light, where the components of the built-in light assembly of the new extension bar, including the light bulb and the battery, are all contained in an insulated casing, so that the built-in light assembly can be easily installed or replaced as one integral unit.

It is a further object of the present invention to provide a new extension bar with built-in light, where the built-in light assembly has a switch mechanism which automatically switches on the built-in light when the extension bar is attached to the driving tool, and switches off the built-in light when the extension bar is detached from the driving tool, so that the built-in light can continuously illuminate the working area when the extension bar is in use, and conserve the battery power when the extension bar is not in use.

Described generally, the present invention is an extension bar used in conjunction with a portable driving tool which has a coupling member. The extension bar has an elongated cylindrical body having a first end and a second end. The first end has a socket for accommodating and receiving the coupling member of the driving tool, and the second end has a coupling member similar to the coupling member of the driving tool. The extension bar has a hollow internal chamber. The socket at the first end is connected to the internal chamber, and the coupling member at the second end has a through bore which is also connected to the internal chamber.

The extension bar has a built-in light assembly installed inside the internal chamber. The built-in light assembly includes a light bulb located adjacent to the through bore at the second end of the elongated cylindrical body. The built-in light assembly also includes a battery for energizing the light bulb. The built-in light assembly additionally includes a tubular casing made of electrical insulation material for housing the light bulb and the battery as one unit and preventing electrical leakage from the battery to the elongated body of the extension bar. The built-in light assembly further includes an electrical conducting and switching mechanism for automatically switching on the light bulb when the extension bar is attached to the driving tool, and switching off the light bulb when the extension bar is detached from the driving tool.

When the extension bar is attached to the driving tool, it serves not only as an extension of the driving tool but also as a flashlight to illuminate the working area. The extension bar can be used with many portable driving tools, including electrical and pneumatic portable driving tools.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
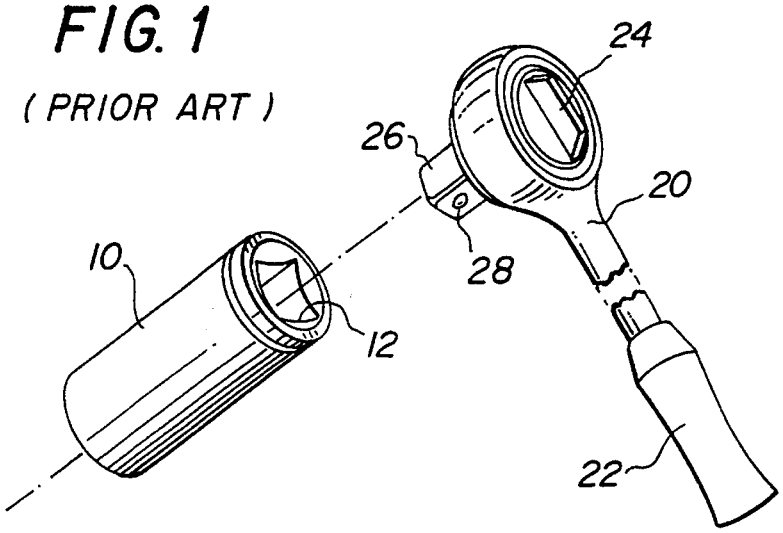
FIG. 1 (PRIOR ART)
FIG. 1 is a perspective view of a prior art driving tool and a prior art socket wrench.
Figure 2:
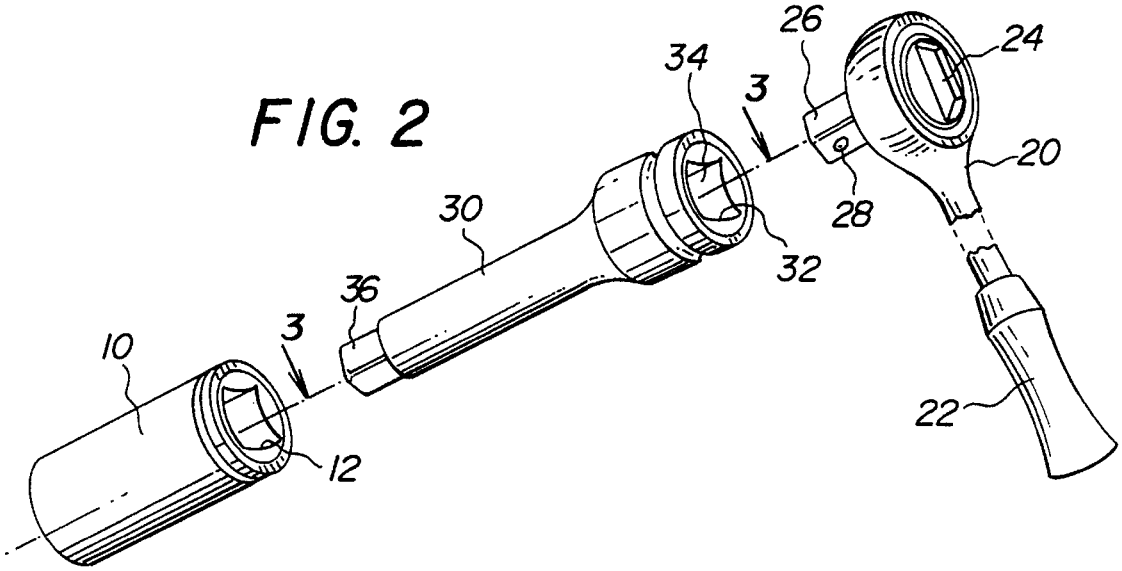
FIG. 2 is a perspective view of the present invention extension bar used in conjunction with a driving tool and a socket wrench.

Referring to FIG. 2, there is shown a present invention extension bar 30 used in conjunction with a driving tool 20 to reach and tighten or loosen a socket 10. As previously described, the socket wrench 10 typically has a socket 12 at its one end, where the socket 12 may be square, hexagonal or polygonal shaped. At one end of the ratchet driver 20 there is a ratchet mechanism 24 including a coupling member 26 which is complementary to and can be received in the socket 12 of the socket wrench 10. The coupling member 26 may have a small spring-biased ball 28 for tight engagement with the socket 10.

It is noted that although a ratchet driver is shown here, the driving tool can be any type of portable driving tool, including electric or pneumatic tools. It is also noted that the present invention extension bar can be used to tighten or loosen a screw head having a socket similar to the socket 12 of the socket wrench 10.

Figure 3:
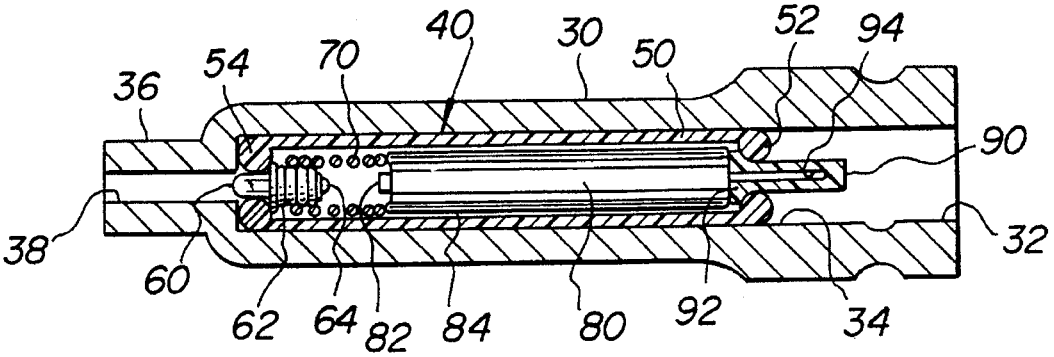
FIG. 3 is a cross-sectional view taken along line 3—3 of FIG. 2.
Figure 4:
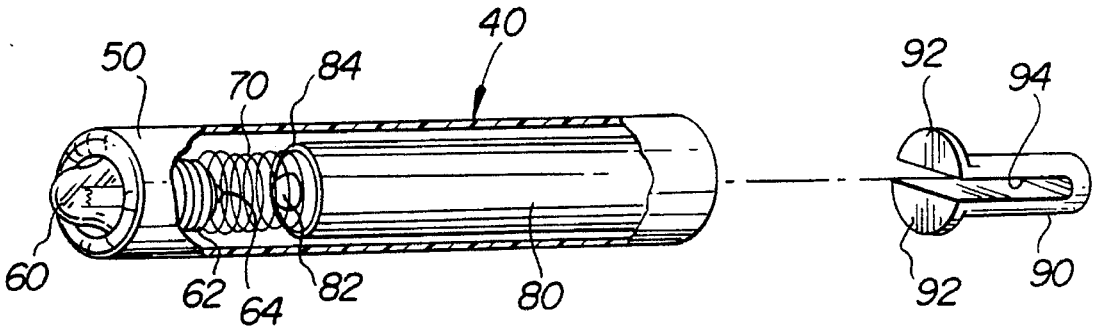
FIG. 4 is a perspective view of the built-in light assembly of the present invention extension bar.
Figure 5:
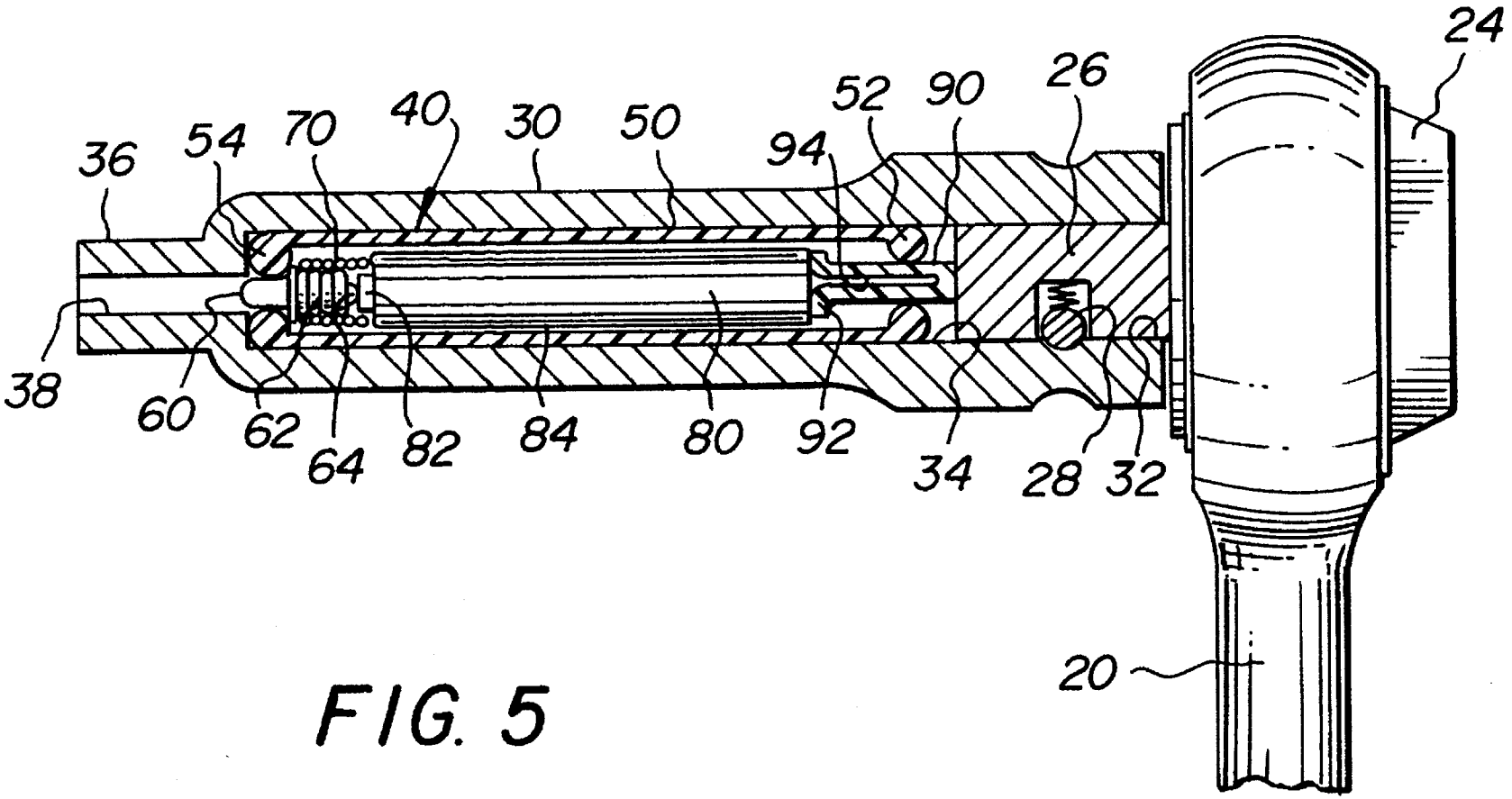
FIG. 5 is a cross-sectional view showing the present invention extension bar attached to a driving tool.

Referring to FIGS. 3 through 5, there is shown one of the preferred embodiments of the present invention extension bar 30. In this embodiment, the present invention extension bar 30 has an elongated cylindrical body with a first end and a second end. The first end of extension bar 30 has a socket 32 for accommodating and receiving the coupling member 26 of the driving tool 20. The second end of the extension bar 30 has a coupling member 36 similar to the coupling member 26 of the driving tool 20.

The socket 32 of the extension bar opens into an internal chamber 34. There is a through bore 38 at the second end of the extension bar which also connects to the internal chamber 34. A built-in light assembly 40 is installed inside the internal chamber 34 of the extension bar 30.

The built-in light assembly 40 is assembled as an integral unit within a tubular casing 50 which is made of an electrical insulation material such as rubber or plastic. The components of the built-in light assembly 40 includes a light bulb 50, a coil spring 70, a battery 80 and a push button 90. The light bulb 60, coil spring 70 and battery 80 are assembled in series inside the tubular casing 50, with the light bulb partially extending out from the second end 54 of the tubular casing 50. Once they are positioned inside the tubular casing 50, the first end 52 and the second end 54 of the tubular casing are rolled or otherwise deformed inwardly to form thickened rims to narrow the end openings for preventing the light bulb 60, coil spring 70 and battery 80 from dropping out.

The light bulb 60 has two terminals: a first terminal 62 which is the sidewall of its base, and a second terminal 64 at the bottom of its base. The battery 80 also has two terminals: a positive terminal 82 at the center of its one end, and a negative terminal 84 which is its sidewall. The coil spring 70 serves as a part of an electrical connection means for establishing electrical connection between the battery 80 and the light bulb 60: one end of the coil spring 70 contacts the first terminal 62 of the light bulb 60, and the other end of the coil spring 70 contacts the negative terminal 84 of the battery 80.

However, the spring force of the coil spring 70 pushes the light bulb 60 and the battery 80 away from each other, and the electrical connection is not completed until the positive terminal 82 of the battery 80 is brought into contact with the second terminal 64 of the light bulb 60. Therefore, the coil spring 70 normally keeps the electrical connection cut-off, and thereby serves as part of a switching mechanism.

Another part of the switching mechanism is the push button 90. As particularly shown in FIG. 4, the push button 90 has a widened flange 92 and a central split 94. Since it has central split 94, the push button 90 can be squeezed laterally to insert its widened flange 92 into the narrowed end opening at the first end 52 of the tubular casing 50. Once the widened flange 92 is inside the narrow first end 52 of the tubular casing 50 and the push button 90 is no longer squeezed laterally, its widened flange 92 will prevent the push button 90 from dropping out from the first end 52 of the tubular casing 50.

When the push button 90 is pushed against the force of the coil spring 70, the battery 80 is pushed inwardly until its positive terminal 82 is brought into contact with the second terminal 64 of the light bulb 60. This will complete the electrical connection and turn on the light bulb 60. When the push button 90 is not pushed, the force of the coil spring 70 will push the battery 80 away from the light bulb 60 and break the contact between the positive terminal 82 of the battery 80 and the second terminal 64 of the light bulb 60, and thereby turn off the light bulb 60.

As particularly shown in FIG. 3, when the built-in light assembly 40 is installed inside the internal chamber 34 of the extension bar 30, the light bulb 60 is located adjacent to, and slightly extending into, the through bore 38 at the second end of the extension bar 30, and the push button is located within the socket 32 at the first end of the extension bar 30.

The tubular casing serves as an electrical insulation between the internal components of the built-in light assembly 40 and the elongated body of the extension bar 30 which is made of an electrical conducting material such as metal. When the extension bar 30 is not attached to the driving tool 20, the push button is not pressed and therefore the light bulb 60 is switched off.

However, as particularly shown in FIG. 5, when the extension bar 30 is attached to the driving tool by inserting the coupling member 26 of the driving tool into the socket 32 of the extension bar 30, the push button 90 is pushed against the spring force by the coupling member 26 of the driving tool. Consequently the positive terminal 82 of the battery 80 is brought into contact with the second terminal 64 of the light bulb 60, and this effectively turns the light bulb on.

Therefore, it can be seen that with this arrangement of the present invention, the built-in light is automatically switched when the extension bar is attached to the driving tool, and automatically switched off when the extension bar is detached from the driving tool. Accordingly, when the extension bar is attached to the driving tool, it serves not only as an extension of the driving tool but also as a flashlight to illuminate the working area.

For example only, the sizes of the present invention extension bar may be ¼" extension bars, ⅜" extension bars, or ½ extension bars. Of course the present invention extension bar may also come in other sizes.

The present invention has many advantages. It provides a new design extension bar is used in conjunction with a driving tool to reach a socket wrench, the extension bar can serve not only as an extension bar but also as a flashlight to illuminate the socket wrench, to easily locate the socket wrench and align the extension bar with the socket wrench. In addition, the components of the built-in light assembly of the new extension bar, including the light bulb and the battery, are all contained in an insulated casing, so that the built-in light assembly can be easily installed or replaced as one integral unit. Furthermore, the built-in light assembly has a switch mechanism which automatically switches on the built-in light when the extension bar is attached to the driving tool, and switches off the built-in light when the extension bar is detached from the driving tool, so that the built-in light can continuously illuminate the working area when the extension bar is in use, and conserve the battery power when the extension bar is not in use.

Defined in detail, the present invention is an extension bar used in conjunction with a portable driving tool which has a coupling member, the extension bar comprising: (a) an elongated cylindrical body having a first end and a second end; (b) the first end of the elongated cylindrical body having a socket for accommodating and receiving the coupling member of the driving tool; (c) the second end of the elongated cylindrical body having a coupling member similar to the coupling member of the driving tool; (d) the elongated cylindrical body further having a hollow internal chamber, the socket at the first end connected to the internal chamber, and the coupling member at the second end having a through bore also connected to the internal chamber; (e) a built-in light assembly installed inside the internal chamber of the elongated cylindrical body; (f) the built-in light assembly including a light bulb located adjacent to the through bore at the second end of the elongated cylindrical body; (g)the built-in light assembly also including a battery for energizing the light bulb; (h) the built-in light assembly further including a circuit connection means for establishing electrical connection between the battery and the light bulb; (i) the circuit connection means having a switch mechanism for automatically switching on the light bulb when the extension bar is attached to the driving tool, and switching off the light bulb when the extension bar is detached from the driving tool; and (j) the built-in light assembly additionally including a tubular casing made of electrical insulation material for housing the light bulb, the battery and the circuit connection means as one unit and preventing electrical leakage from the battery to the elongated body of the extension bar; (k) whereby when the extension bar is attached to the driving tool, it serves not only as an extension of the driving tool but also as a flashlight to illuminate the working area.

Defined broadly, the present invention is an extension bar used in conjunction with a portable driving tool which has a coupling member, the extension bar comprising: (a) an elongated body having a socket for accommodating and receiving the coupling member of the driving tool at one end, and a coupling member at an opposite end; (b) the socket connected to an internal chamber of the elongated body, and the coupling member having a through bore also connected to the internal chamber; (c) a built-in light assembly installed inside the internal chamber of the elongated body and including a light bulb and a battery, the light bulb located adjacent to the through bore; and (d)the built-in light assembly further comprising a circuit connection means for establishing electrical connection between the battery and the light bulb, including a switch mechanism for automatically switching on the light bulb when the extension bar is attached to the driving tool, and switching off the light bulb when the extension bar is detached from the driving tool; (e) whereby when the extension bar is attached to the driving tool, it serves not only as an extension of the driving tool but also as a flashlight to illuminate the working area.

Defined more broadly, the present invention is an extension bar used in conjunction with a portable driving tool which has a coupling member, the extension bar comprising a light bulb and a battery installed inside an internal bore of the extension bar and an electrical conducting and switching mechanism for automatically switching on the light bulb when the extension bar is attached to the driving tool, and switching off the light bulb when the extension bar is detached from the driving tool.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An extension bar for use with a portable driving tool having a coupling member, said extension bar comprising:

an elongated body having an internal chamber, said body having a socket for accommodating and receiving said coupling member of said driving tool at one end and a coupling member at an opposite end, said socket being connected to said internal chamber, said coupling member having a through bore connected to said internal chamber; and a built-in light assembly disposed in said internal chamber, said assembly comprising a light bulb, a battery, a circuit connection means for establishing electrical connection between said battery and said light bulb and including a switch mechanism for automatically switching on said light bulb when said extension bar is attached to said driving tool and switching off said light bulb when said extension bar is detached from said driving tool, and a tubular casing for housing said light bulb, said battery, and said circuit connection means, said tubular casing being made of an electrical insulation material for preventing electrical leakage from said battery to said elongated body and having opposing ends provided with thickened rims for retaining said light bulb and said battery, said assembly being disposed in said internal chamber so that said light bulb is adjacent to said through bore, whereby when said extension bar is attached to said driving tool said extension bar serves not only as an extension of said driving tool but also as a flashlight to illuminate a working area.

2. The extension bar of claim 1, wherein the circuit connection means includes a coil spring for keeping the battery and the light bulb from contacting one another.

3. The extension bar of claim 2, wherein the light bulb has a first terminal at a sidewall of a base of the light bulb and a second terminal at a bottom of said base of the light bulb, the battery has a positive terminal at a top end of the battery and a negative terminal at a sidewall of the battery, and the coil spring is positioned between the light bulb and the battery so that the coil spring contacts said first terminal of the light bulb and said negative terminal of the battery and prevents said second terminal of the light bulb from contacting said positive terminal of the battery.

4. The extension bar of claim 3, wherein the switch mechanism includes a push button located within the socket of the body, said push button being pushed when the coupling member of the driving tool is received in the socket of the body which in turn pushes the battery toward the light bulb against a force of the coil spring so that the positive terminal of the battery contacts the second terminal of the light bulb to thereby turn on the light bulb.

5. The extension bar of claim 4, wherein the push button has a widened flange disposed inside the tubular casing at a location opposite to the light bulb, said flange engaging with one of the thickened rims of the tubular casing to retain the push button in the tubular casing.

6. The extension bar of claim 5, wherein the push button has a central slit so that the push button can be squeezed laterally to allow for insertion of the widened flange into the tubular casing.

7. An extension bar for use with a portable driving tool, said extension bar comprising:

a hollow, cylindrical body, said body having a first open end for receiving a coupling member of said driving tool and a second open end for coupling said body to a socket wrench;

a tubular casing disposed in said body, said tubular casing being formed of an electrically insulative material and having first and second open opposing ends provided with thickened rims;

a light bulb disposed at said second open end of said tubular casing;

a battery for powering said light bulb, said battery being disposed in said tubular casing;

a coil spring disposed between said light bulb and said battery; and a button member disposed at said first open end of said tubular casing opposite said light source, a portion of said button member protruding from said first open end of said tubular casing.

8. The extension bar of claim 7, wherein a portion of the light bulb protrudes from the second open end of the tubular casing.

9. The extension bar of claim 7, wherein the button member has a flange for engaging with said thickened rim of the first open end of the tubular casing to retain the button member in the tubular casing.

* * * * *